United States Patent [19]

Osato et al.

[11] 4,272,653

[45] Jun. 9, 1981

[54] LOUDSPEAKER AND A METHOD OF PRODUCING THE SAME

[75] Inventors: Mamoru Osato, Yokosuka; Hiroshi Koizumi, Ohmiya, both of Japan

[73] Assignee: Sony Corporation, Tokyo, Japan

[21] Appl. No.: 48,389

[22] Filed: Jun. 14, 1979

[30] Foreign Application Priority Data

Jun. 15, 1978 [JP] Japan ..... 53-72426

[51] Int. Cl.[3] ..... H04R 7/02

[52] U.S. Cl. ..... 179/115 R

[58] Field of Search ..... 181/173, 174; 179/115.5 ES, 115 R, 115.5 R

[56] References Cited

U.S. PATENT DOCUMENTS 4,122,319 10/1978 Matsuba et al. ..... 179/115.5 R

*Primary Examiner*—Vincent P. Canney

*Attorney, Agent, or Firm*—Lewis H. Eslinger; Alvin Sinderbrand

[57] ABSTRACT

A loudspeaker comprises a diaphragm including first and second layers and a core member sandwiched between the layers, in which the core member has an edge or peripheral surface aslant relative to the direction of thickness thereof; and a drive assembly, which includes a voice coil wound around a voice coil bobbin and which is connected to a node portion of the diaphragm when vibrated in its divided vibration mode. A support structure supports the diaphragm and the drive assembly, and includes a frame and an edge member secured to the frame, the edge member having a first portion corresponding to the slant of the edge surface of the diaphragm and which is adhesively connected thereto.

14 Claims, 12 Drawing Figures

LOUDSPEAKER AND A METHOD OF PRODUCING THE SAME

BACKGROUND OF THE INVENTION

1. Field of the Invention

This invention relates generally to loudspeakers, and more particularly, to a novel structure of a loudspeaker designed to drive the node portion of a diaphragm which vibrates in its divided vibration mode by moving such node portion to a suitable location without changing the radiation area of the diaphragm. This invention also relates to a method of bonding the diaphragm to an edge member of the loudspeaker frame.

2. Description of the Prior Art

In conventional loudspeakers having a planar diaphragm, there is typically employed a nodal driving system which is designed to drive the node portion of a diaphragm vibrating in its low-order divided vibration mode so as to bring the divided vibration mode of the diaphragm to a higher frequency range.

These loudspeakers generally have a planar diaphragm whose front and rear surfaces are of equal area. Since the vibration mode is determined by the radiation area, that is, the surface area of the diaphragm, the size of the voice coil for driving a node portion of the diaphragm in its divided vibration mode is also determined by the radiation area of the planar diaphragm.

In such conventional loudspeakers, the diameter of the voice coil is naturally larger if the diaphragm surface area is greater, and this necessitates a correspondingly large structure for of the magnetic circuit, frame and other associated elements, so that the production of such loudspeakers is subject to extensive structural restrictions and elevated costs.

Also, in conventional loudspeakers, the peripheral edge of the diaphragm is cut vertical to the vibration plane, that is, transverse to the direction of thickness thereof. Thus, attaching the diaphragm to the correspondingly shaped edge member for securing the diaphragm to the frame, the adhesive used for this purpose often contacts and sticks to an unintended portion of the diaphragm or is often forced out from the bonded portions as the peripheral face of the diaphragm slides against the internal face of the edge member. In order to avoid such problems, the prior art expanded the edge member prior to attachment or used a non-tacky adhesive. Further, by using a planar diaphragm of a honeycomb sandwich structure, a rough trembling sound is often produced, because of the force or interaction of the layers of the honeycomb core, when the diaphragm vibrates, unless secure adhesion is made between the planar diaphragm and the edge member. Moreover, sufficient pressure must be applied to the joined area of the edge member and diaphragm because the adhesive may undergo a so-called slimming phenomenon when it sets.

SUMMARY OF THE INVENTION

In view of the above, it is an object of this invention to provide a novel loudspeaker which is free of the above-described problems encountered with conventional loudspeakers, and a method of producing such loudspeaker.

More specifically, an additional object of this invention is to provide a novel loudspeaker in which a node portion of the diaphragm in its vibration mode can be repositioned without changing the radiation area of the planar diaphragm.

Another object of this invention is to provide a loudspeaker whose design and manufacture is not unduly restricted.

Still another object of this invention is to provide a loudspeaker having good quality at low cost.

It is yet another object of this invention to provide a novel method for bonding the planar diaphragm to a frame-securing edge and edge member, the method being capable of being performed with high efficiency and reliability without first requiring an edge member expanding step, to effectively produce a simplification of the bonding jig used in the operation.

In accordance with an aspect of this invention, a loudspeaker includes a diaphragm having first and second layers and a core member sandwiched between the layers, the core member having an edge surface aslant relative to the direction of thickness thereof. The loudspeaker further includes means for driving the diaphragm at its node portion when vibrating in the divided vibration mode thereof. Preferably, the diaphragm is supported by a frame to which it is adhesively secured by an edge member.

Also, in accordance with another aspect of this invention, a method of constructing the above loudspeaker includes disposing the edge member on an assembly base having a side wall aslant at an angle corresponding to the angle of slant of the diaphragm edge, applying an adhesive to at least the edge surface of the diaphragm or to the surface of the edge member, placing the diaphragm into contact with a surface portion of the edge member, and pressing the diaphragm into good bonding contact with the edge member.

The above, and other, objects, features and advantages of the present invention will become apparent from the following detailed description of illustrative embodiments of the invention which is to be read in conjunction with the accompanying drawings.

DESCRIPTION OF THE PREFERRED EMBODIMENTS

Figure 1:
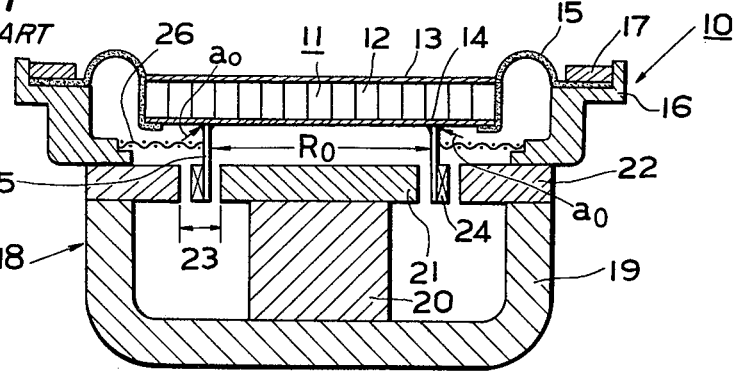
FIG. 1 PRIOR ART
FIG. 1 is a cross-sectional view of a conventional loudspeaker provided with a planar diaphragm.

Referring to the drawings, and initially to FIG. 1, there is shown a conventional loudspeaker 10 comprised of a thick-walled planar diaphragm 11 with low surface density and high rigidity, the diaphragm being, for example, of a honeycomb sandwich structure having a core member 12 and first and second layers 13, 14 arranged to sandwich the core member, an edge member 15 joined to a peripheral part of the diaphragm, and a frame 16 on which the diaphragm is mounted by means of said edge member 15. Edge member 15 is secured to frame 16 by means of a gasket 17. Also mounted on the frame 16 is a magnetic circuit 18 comprising a U-shaped yoke 19, a magnet 20 disposed in the center of the yoke, a pole member 21 joined to the head of the magnet, a plate 22 carried on the yoke, and a voice coil 24 disposed in a magnetic gap 23 defined by pole member 21 and plate 22. Voice coil 24 is wound on a voice coil bobbin 25 which is joined at one end thereof to a vibration mode node portion $a_o$ the planar diaphragm. The voice coil bobbin 25 is supported by the frame 16 by a damper 26 so as to be fixed in position in the magnetic gap 23.

In such conventional loudspeaker mechanism 10, the planar diaphragm 11 has, for instance, a rectangular parallelpiped configuration with the same area on both front and rear surfaces, and the vibration mode is determined by the radiation area of the diaphragm. Thus, the position of the node portion $a_o$ of the vibration mode is also determined according to the radiation area. However, the voice coil 24 for driving the vibration mode node portion $a_o$ of the planar diaphragm 11 has a diameter $R_o$ which is determined by the radiation area of the diaphragm 11. For example, if the planar diaphragm 11 has a 270 mm×270 mm square radiation area, the voice coil 24 must have a diameter $R_o$ on the order of 213 mm. Any increase in the voice coil diameter $R_o$ necessitates a corresponding enlargement of the structural size of the magnetic circuit 18, frame 16 and other associated elements, so that extensive structural restrictions are imposed in the production of such loudspeaker and the production cost is increased.

Figure 2:
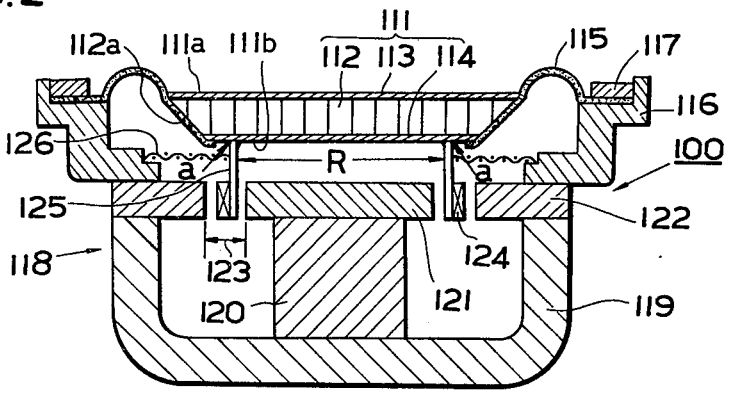
FIG. 2 is a cross-sectional view of an embodiment of a loudspeaker according to this invention.

Referring now to FIG. 2, there is shown a loudspeaker 100 according to this invention, comprising a planar diaphragm 111 of, for example, a honeycomb sandwich structure including a core layer 112 which is greater in area on its front surface than its rear surface and which is a peripheral edge face 112*a* which is at an angle or aslant relative to the direction of thickness of the core layer 112. The diaphragm further includes layers 113 and 114 joined to the front and rear surfaces, respectively, of the core layer 112. Diaphragm 111 is supported at its outer peripheral edge by loudspeaker frame 116 by means of edge member 115. Secured to the frame 116 is a magnetic circuit 118 which is comprised of a U-shaped yoke 119, a magnet 120 disposed in the center of the yoke, a pole member 121 joined to the head of the magnet, and a plate 122 carried on the yoke, the circuit 118 being substantially the same as the mechanism used in conventional loudspeakers. A voice coil bobbin 125 is also supported by the frame 116 through a damper member 126 such that voice coil 124 is disposed in the magnetic gap 123.

According to the mechanism of this invention, the voice coil bobbin 125 is joined at an end thereof to a vibration mode node portion a of the planar diaphragm 111.

Figure 3A:
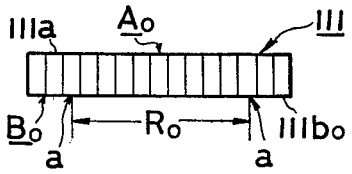
FIGS. 3(A), (B), and (C) are schematic diagrams, illustrating the locations of the node portion of a planar diaphragm, according to different diaphragm embodiments.
Figure 3B:
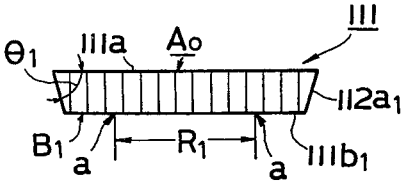
Figure 3C:
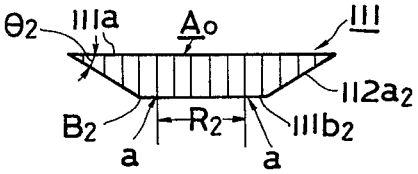

The planar diaphragm 111 is cut aslant, that is, inclined at an angle, at its outer peripheral portion edge to form a peripheral end face 112*a* which is aslant relative to the direction of thickness thereof so that the front surface 111*a* (that is, the radiation surface) is greater in area than the rear surface 111*b*. Thus, the diaphragm is shaped so as to present a trapezoidal cross-sectional configuration. This results in reduced mass and flexural rigidity of the diaphragm as a whole, and the vibration mode node portion a is shifted toward the center. In the case where the planar diaphragm, of a honeycomb structure, has a given surface configuration, such as square or circular, a fixed vibration mode is produced by imparting a forced vibration, and a node is formed at a predetermined position. Thus, given that the distance between the nodes a is $R_o$, when the area $A_o$ of the front surface 111*a* (radiation area) is equal to the area $B_o$ of the rear surface 111*b*, as shown in FIG. 3(A), if the outer peripheral edge of the diaphragm is cut aslant, without changing the radiation area $A_o$, so as to provide a peripheral end face 112*a*$_1$ or 112*a*$_2$ with an angle of inclination $\theta_1$ or $\theta_2$ and so as to have a radiation area $A_o=B_o>B_1>B_2$ ($B_1$ and $B_2$ being the areas of the rear surfaces 111*b*$_1$, and 111*b*$_2$, respectively), the distance between the nodes a of this vibration mode will be $R_o>R_1>R_2$, respectively, as shown in FIGS. 3A, 3B and 3C. The diameter R of the voice coil 124 is determined by the distance $R_1$ or $R_2$ between the nodes a.

Figure 4:
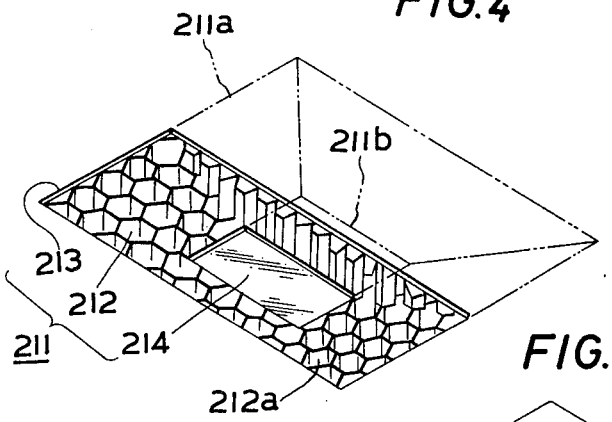
FIG. 4 is a partially cut-out perspective view showing one embodiment of an external configuration of the planar diaphragm employed in this invention.
Figure 5:
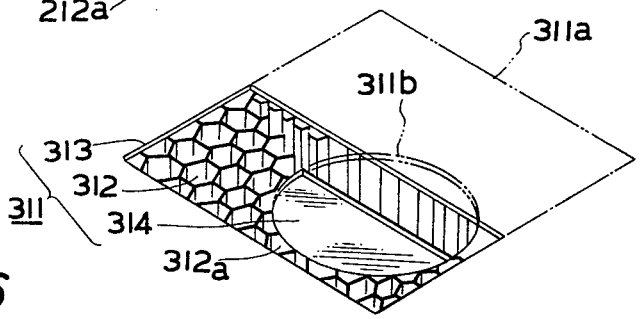
FIG. 5 is a partially cut-out, perspective view, showing another embodiment of an external configuration of the planar diaphragm employed in this invention.
Figure 6:
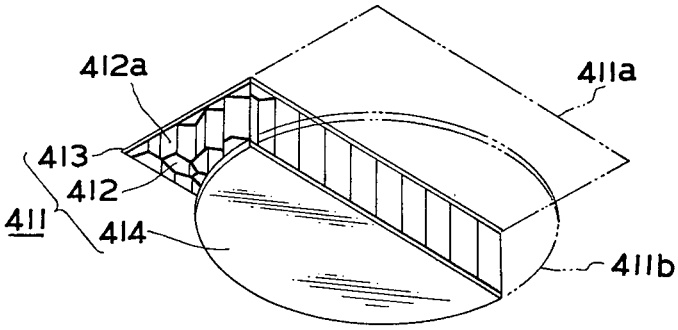
FIG. 6 is a partially cut-out, perspective view, showing still another embodiment of an external configuration of the planar diaphragm.

The diaphragm according to this invention includes various structural embodiments such as shown in FIGS. 4 through 6.

FIG. 4 shows an embodiment where both front surface 211*a* and rear surface 211*b* of the planar diaphragm 211 are of a square configuration. In the embodiments of FIGS. 5 and 6, the front surface 311*a* and 411*a* of the diaphragms 311 and, 411 are of a square configuration while the rear surface are of a circular shape. The rear surface 311*b* of the diaphragm 311 of FIG. 5 is smaller in diameter than rear surface 411*b* of FIG. 6.

In each of these embodiments, the peripheral edge of the core layer (212,312,412) of the diaphragm (211,311, 411) is cut aslant to form an inclined end face (212*a*, 312*a*, 412*a*) so that the front surface (211*a*,311*a*,411*a*) and the rear surface (211*b*,311*b*,411*b*) of the layers (213,214;313,314;413,414) joined to the core layer (212, 312,412) are different in area from each other. Therefore, according to these embodiments of this invention, the voice coil 124 for driving node portion a of the planar diaphragm 111 may be smaller in diameter R than the voice coil used in conventional loudspeakers, such as shown in FIG. 1, thus alleviating the structural restrictions on the component elements, such as the magnetic circuit 118, in the production of such loudspeakers.

The method of bonding the peripheral portion of the diaphragm to the edge member in the loudspeaker according to this invention now will be described by referring through FIGS. 7 to 10.

Figure 7:
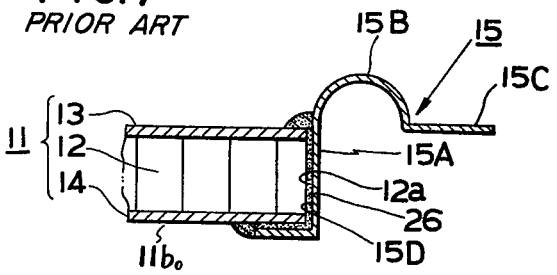
FIG. 7 PRIOR ART
FIG. 7 is an enlarged cross-sectional view of the principal parts of a known mechanism for bonding the planar diaphragm to a frame-securing edge member as employed in the conventional loudspeaker shown in FIG. 1.
Figure 8:
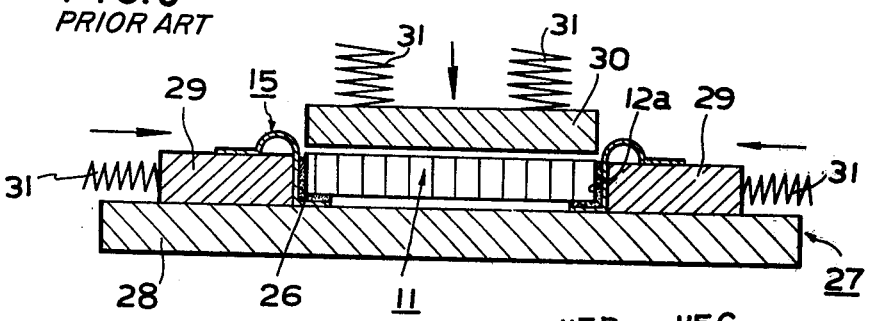
FIG. 8 PRIOR ART
FIG. 8 is a cross-sectional view showing a conventional bonding jig assembly used in the bonding operation performed with the known bonding mechanism of FIG. 7.

In the conventional planar diaphragm shown in FIG. 1, the peripheral portion is cut in the direction of thickness so as to provide a desired surface configuration for example, circular or square. As shown in FIG. 7, the peripheral portion or end face 12*a* is bonded to an edge member 15 with an adhesive 26. The edge member 15 consists of a bond portion 15A corresponding to the end face 12*a*, an elastic support portion 15B which extends from bond portion 15A and which as a semi-circular cross-sectional configuration, and a flange portion 15*c* secured to the frame 16 by gasket 17. The bond portion 15A may extend to the rear surface 11*b* of the diaphragm 11. The inner surface 15D of the bond portion 15A facing; to the diaphragm 11 is bonded to the end face 12*a* of the diaphragm 11 by using a jig 27, such as shown in FIG. 8. Jig 27 comprises a support 28, a side pressing member 29 disposed on support 28 and including four sections, and a top pressing member 30 disposed between the sections of the side pressing member 29 and disposed above the diaphragm 11.

In performing the actual bonding operation, the side pressing member 29 is initially expanded out to provide a space sufficient to allow easy insertion of the edge member 15. After inserting the edge member and applying an adhesive 26 either to the inner surface 15D of the bond portion 15A of the edge member 15 or to the corresponding peripheral portion 12*a* of the diaphragm 11, the diaphragm 15 is inserted into the edge member 15 from above. The pressing members 29 and then 30 are pressed toward the diaphragm by using suitable means such as springs 31 to press-bond the peripheral portion 12*a* of diaphragm 11 and edge member 15.

According to this method, however, since the peripheral end face 12*a* of the diaphragm 11 is cut vertical to the direction of thickness, the adhesive often contacts and sticks to an unintended portion when inserting the diaphragm 11 into the edge member 15. In some instances the adhesive is forced out from the bonded area. Also, the jig used with this diaphragm is of a complicated structure and is large and bulky.

Figure 10:
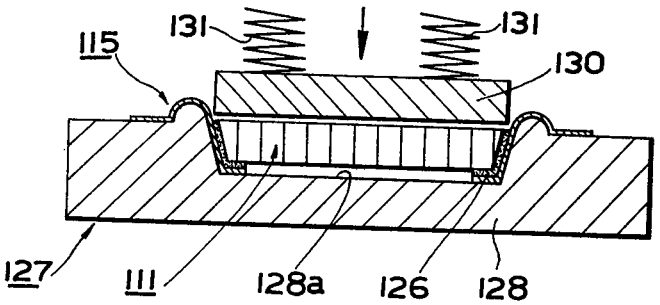
FIG. 10 is a cross-sectional view showing an embodiment of the bonding jig used in the bonding operation according to the bonding mechanism of this invention.

FIG. 10 shows an apparatus for which can optimally be used to bond the edge member bonding method to the diaphragm for the loudspeaker of this invention.

Figure 9:
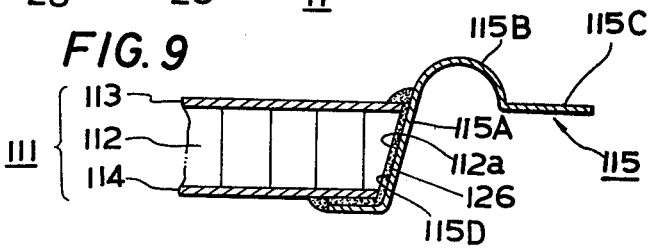
FIG. 9 is an enlarged cross-sectional view of the principal parts of a bonding mechanism used in the method of this invention.

FIG. 9 shows the principal parts of the loudspeaker 100 of FIG. 2. It will be seen that the edge member 115 consists of a bond portion 115A having an inner surface 115D aslant or at an angle corresponding to the peripheral end face 112*a* of the planar diaphragm 111, an elastic support portion 115B which extends from bond portion 115A and which has a semi-circular cross-sectional configuration, and a flange portion 115C secured to the frame 116 by gasket 117. The peripheral end face 12*a* of planar diaphragm 111 is bonded by an adhesive 126 to the corresponding inner surface 115D of the bond portion 115A of the edge member 115.

For bonding the planar diaphrgm 111 to the edge member 115, there is employed a bonding jig assembly 127 (FIG. 10) comprising a base block 128 formed with a recess 128*a* having an inverted trapezoidal cross-sectional shape to allow the fitting thereinto of the edge member 115 and diaphragm 111, and a press member 130 adapted to press the diaphragm 111 in the vertical direction toward the base block 128. An adhesive 126 is applied to the peripheral end face 112*a* of the diaphragm 111 and/or to the inner surface 115D of the bond portion 115 of the edge member 115. The bond portion 115A of the edge member 115 is inserted first into the recess 128*a* in the base block 128 and then the planar diaphragm 111 then is placed thereinto so that the peripheral end face 112*a* contacts the inner surface 115D of said bond portion 115A. The diaphragm 111 is then pressed by the press member 130 (under the force of spring 131 or other means) toward the base block 128 to thereby effect bonding of the planar diaphragm 111 and edge member 115.

According to the above operation, the planar diaphragm 111 can be simply inserted into its correct position without the need for expanding the edge member 115. Also, since the peripheral end face 112*a* of the diaphragm 111 can be pressed against the corresponding inner surface 115D of the bond portion 115A of the edge member 115 by merely pressing the diaphragm 111 toward the base block 128, that is, only in the vertical direction, the bonding jig 127 used for the assembly operation is greatly simplified in structure.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A loudspeaker comprising:

a planar diaphragm, including first and second layers, and a core member sandwiched between said layers, said core member having an edge surface aslant relative to the direction of thickness thereof;

means for driving said diaphragm at a node portion of a divided vibration mode thereof in accordance with an electrical drive signal supplied thereto; and support means for supporting said diaphragm and said driving means.

2. A loudspeaker according to claim 1, wherein said diaphragm has a honeycomb structure.

3. A loudspeaker according to claim 1, wherein said first layer of said diaphragm has a square shape.

4. A loudspeaker according to claim 1, wherein said first and second layers of said diaphragm have a square shape.

5. A loudspeaker according to claim 1, wherein said second layer of said diaphragm has a circular shape.

6. A loudspeaker according to claim 1, wherein said support means includes a frame member and a damping means for supporting said driving means.

7. A loudspeaker according to claim 1, wherein said support means includes a frame member and an edge member having a first portion connected to said edge surface of said diaphragm and a second portion connected to said frame member.

8. A loudspeaker according to claim 7, wherein said first portion of said edge member has a surfacd which is aslant at an angle corresponding to the angle of slant of said diaphragm.

9. A loudspeaker according to claim 1, wherein said driving means includes magnet means defining an air gap having a magnetic field therein, voice coil means attached to said diaphragm and having a bobbin and a voice coil wound around said bobbin, said voice coil being disposed in said magnetic field, and means for providing said voice coil with said varying electrical input signal.

10. A loudspeaker according to claim 1, wherein said core member includes a front surface and a rear surface, said front surface having a larger surface area than said rear surface.

11. A loudspeaker according to claim 10, wherein said first layer is in contact with said front surface and said second layer is in contact with said rear surface.

12. A loudspeaker comprising:

a planar diaphragm including first and second layers, and a core member sandwiched between said layers, said core member having an edge surface aslant relative to the direction of thickness thereof and further having a front surface and a rear surface, said front surface having a larger surface area than said rear surface;

means for driving said diaphragm at a node portion of a divided vibration mode thereof in accordance with a varying electrical signal supplied thereto;

a frame member; and an edge member including a first portion having a surface aslant at an angle corresponding to the angle of slant of said edge surface of said diaphragm and adhesively connected thereto, and a second portion connected to said frame member.

13. A method of making a loudspeaker of the type which includes a planar diaphragm having first and second layers, and a core member sandwiched between said layers, said core member having an edge surface aslant relative to the direction of thickness thereof; means for driving said diaphragm at a node portion of a divided vibration mode thereof in accordance with a varying electrical signal supplied thereto; a frame member; and an edge member having a first portion with a surface aslant at an angle corresponding to the angle of slant of said edge surface of said diaphragm and adapted to be connected thereto, and a second portion adapted to be connected to said frame member, said method comprising the steps of:

disposing said edge member on an assembly base having a side wall aslant at an angle corresponding to the angle of slant of said first portion of said edge member;

applying an adhesive to a selected one of said edge surface of the diaphragm or said surface of said first portion of the edge member;

placing said diaphragm in contact with said edge member such that said edge surface contacts said surface of said first portion of said edge member; and pressing said diaphragm to said edge member in the direction of thickness of said diaphragm.

14. A method of making a loudspeaker according to claim 13, wherein said step of pressing comprises pressing said diaphragm with a pressing member situated above said diaphragm.

* * * * *